US005168284A

United States Patent [19]

Yeung

[11] Patent Number: 5,168,284

[45] Date of Patent: Dec. 1, 1992

[54] PRINTHEAD TEMPERATURE CONTROLLER THAT USES NONPRINTING PULSES

[75] Inventor: King-Wah W. Yeung, Cupertino, Calif.

[73] Assignee: Hewlett-Packard Company, Palo Alto, Calif.

[21] Appl. No.: 694,185

[22] Filed: May 1, 1991

[51] Int. Cl.[5] ..... B41J 2/05

[52] U.S. Cl. ..... 346/1.1; 346/140 R

[58] Field of Search ..... 346/1.1, 140 R, 76 PH; 400/120, 54

[56] References Cited

U.S. PATENT DOCUMENTS

| | | | |
|---|---|---|---|
| 4,313,684 | 2/1982 | Tazaki | 400/322 |
| 4,490,728 | 12/1984 | Vaught et al. | 346/1.1 |
| 4,496,824 | 1/1985 | Kawai et al. | 346/76 PH X |
| 4,510,507 | 4/1985 | Ishikawa | 346/76 PH |
| 4,590,362 | 5/1986 | Ishima | 219/497 |
| 4,590,488 | 5/1986 | Sullivan | 346/76 PH |
| 4,791,435 | 12/1988 | Smith et al. | 346/140 |
| 4,797,837 | 1/1989 | Brooks | 346/76 PH X |
| 5,046,859 | 9/1991 | Yamaguchi | 346/76 PH X |
| 5,109,234 | 4/1992 | Otis, Jr. et al. | 346/1.1 |

FOREIGN PATENT DOCUMENTS 0076275 5/1984 Japan .

*Primary Examiner*—Benjamin R. Fuller
*Assistant Examiner*—Alrick Bobb

[57] ABSTRACT

This document discloses a method and apparatus for real-time control of the temperature of thermal ink jet printheads and thermal printheads through the use of nonprinting pulses. A closed-loop system produces nonprinting pulses in response to a difference between a reference temperature signal and a printhead temperature signal produced by a temperature sensor on the printhead so that the printhead operates at a constant elevated temperature. The reference temperature signal can specify an operating temperature anywhere between 10° C. and 100° C. above room temperature. The closed-loop system can have multiple loops with different response times so that complex nonlinear responses to changes in the printhead temperature can be obtained. The open-loop system transmits nonprinting pulses to the printhead for each printing interval that the printer does not eject a drop. Also, this document discloses a method for measuring the energy transfer characteristics of a printhead. This method is used to determine how much energy open-loop nonprinting pulses should transmit within one printing interval to the printhead to prevent fluctuations in the temperature of the printhead caused by variations in the printer output.

15 Claims, 3 Drawing Sheets

PRINTHEAD TEMPERATURE CONTROLLER THAT USES NONPRINTING PULSES

FIELD OF THE INVENTION

This invention relates generally to thermal ink jet and thermal printing systems, and is more particularly directed to controlling the temperature of thermal ink jet and thermal printheads.

BACKGROUND OF THE INVENTION

Thermal ink jet printers are well known in the art and are illustrated in U.S. Pat. Nos. 4,490,728 and 4,313,684. The thermal ink jet printhead has an array of precisely formed nozzles, each having a chamber which receives ink from an ink reservoir. Each chamber has a thin-film resistor, known as a firing resistor, located opposite the nozzle so ink can collect between the nozzle and the firing resistor. When printing pulses heat the firing resistor, a small portion of the ink directly adjacent to the firing resistor vaporizes. The rapidly expanding ink vapor displaces ink from a nozzle causing drop ejection. The ejected drops collect on a print medium to form printed characters and images.

Printhead temperature fluctuations have prevented the realization of the full potential of thermal ink jet printers because these fluctuations produce variations in the size of the ejected drops which result in degraded print quality. The size of ejected drops varies with printhead temperature because two properties that control the size of the drops vary with printhead temperature: the viscosity of the ink and the amount of ink vaporized by a firing resistor when driven with a printing pulse. Printhead temperature fluctuations commonly occur during printer startup, during changes in ambient temperature, and when the printer output varies. For example, temperature fluctuations occur when the printer output changes from normal print to "blackout" print (i.e., where the printer covers the page with dots).

When printing text in black and white, the darkness of the print varies with printhead temperature because the darkness depends on the size of the ejected drops. When printing gray-scale images, the contrast of the image varies with printhead temperature because the contrast depends on the size of the ejected drops.

When printing color images, the printed color varies with printhead temperature because the printed color depends on the size of all the primary color drops that create the printed color. If the printhead temperature varies from one primary color nozzle to another, the size of drops ejected from one primary color nozzle will differ from the size of drops ejected from another primary color nozzle. The resulting printed color will differ from the intended color. When all the nozzles of the printhead have the same temperature but the printhead temperature increases or decreases as the page is printed, the colors at the top of the page will differ from the colors at the bottom of the page. To print text, graphics, or images of the highest quality, the printhead temperature must remain constant.

Thermal printers are well known in the art. The printheads have an array of heating elements that either heat thermal paper to produce a dot on the thermal paper or heat a ribbon (which can have bands of primary color inks as well as black ink) to transfer a dot to the page. In either case, fluctuations in the printhead temperature produce fluctuations in the size of the printed dot which affect the darkness of the print when printing in black and white, the gray-tone when printing in gray scale, and the resulting printed color when printing in color.

SUMMARY OF THE INVENTION

For the reasons previously discussed, it would be advantageous to have a method and apparatus for controlling the temperature of thermal ink jet printheads and thermal printheads. The foregoing and other advantages are provided by the present invention which is a method and apparatus for controlling in real time (i.e., during the print cycle of the printer) the temperature of a thermal ink jet printhead or a thermal printhead through the use of nonprinting pulses (i.e., pulses that do not have sufficient energy to cause the printhead to fire). The invention includes an open-loop energy compensation system, a closed-loop temperature regulation system, and a combination of both.

The open-loop energy compensation system has three main components: a thermal ink jet printhead, an open-loop pulse generator, and a data interpreter. The thermal ink jet printhead has firing resistors which cause drops to eject when driven with printing pulses in response to print commands. The printhead also has a known energy transfer characteristic such that X is the percentage of the energy of a printing pulse transferred to an ejected drop and (100−X) is the percentage of the energy of the printing pulse absorbed by the printhead. The open-loop pulse generator generates either a printing pulse having an energy $E_p$ for delivery to the firing resistor to eject an ink drop that carries the energy $E_p(X/100)$ and to heat the printhead with the remaining energy $E_p[(100-X)/100]$, or one or more open-loop nonprinting pulses having a total energy of $E_p[(100-X)/100]$ that only heat the printhead. The data interpreter interprets the print data and instructs the pulse generator to transmit the printing pulse when the print data contains a print command and to transmit one or more open-loop nonprinting pulses in place of a printing pulse when the data does not contain a print command so that the printhead dissipates the same amount of power regardless of the print data content.

The closed-loop temperature regulation circuit has a temperature sensor, an error detection amplifier, and a means for generating closed-loop nonprinting pulses. The temperature sensor senses the printhead temperature and produces a real-time printhead temperature signal. The error detection amplifier has an input connected to a reference temperature signal, has an input connected to the printhead temperature signal, and generates a real-time error output signal that is a function of the difference between the reference temperature signal and the printhead temperature signal. The means for generating closed-loop nonprinting pulses uses the error output signal to control the timing of closed-loop nonprinting pulses and the energy transmitted to the printhead by the closed-loop nonprinting pulses to achieve real-time, closed-loop control of the printhead temperature.

DETAILED DESCRIPTION OF THE INVENTION

Persons skilled in the art will readily appreciate the advantages and features of the disclosed invention after reading the following detailed description in conjunction with the drawings.

Figure 1A:
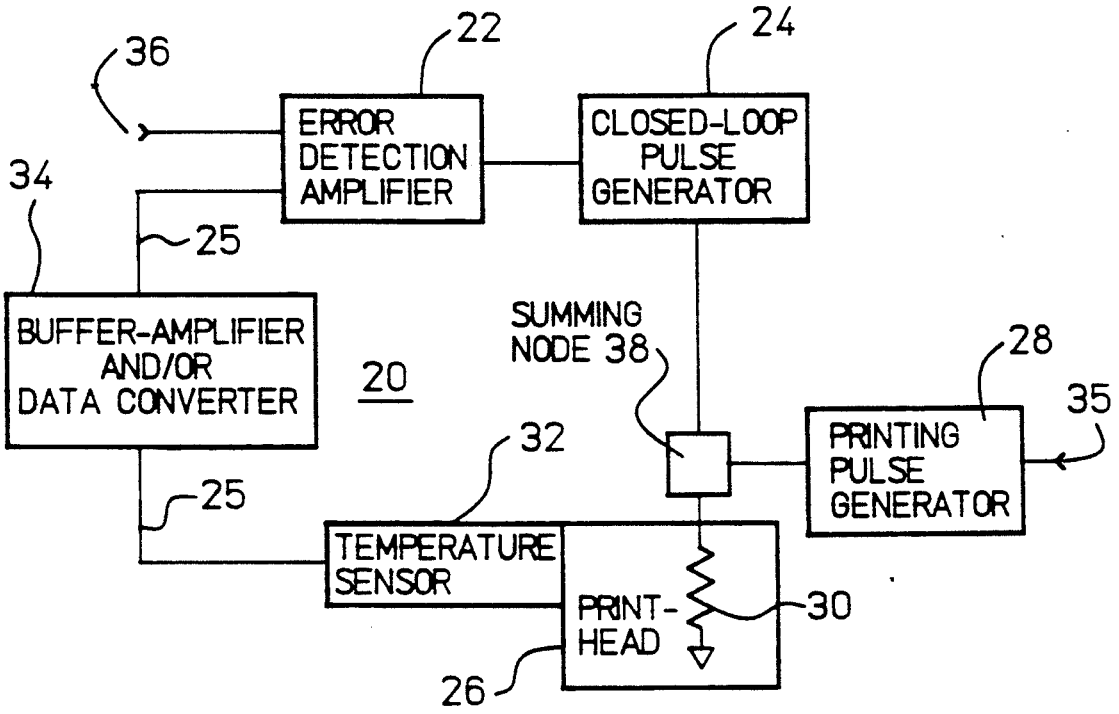
FIG. 1A shows a block diagram of the closed-loop temperature regulation system for maintaining constant printhead temperature.

FIG. 1A shows a block diagram of a closed-loop temperature regulation system 20. This closed-loop system has the advantage of rapidly and precisely regulating the temperature of the printhead and maintaining it at a constant temperature regardless of changes in the operating conditions of the printer such as, the startup condition, large or small changes in the ambient temperature, and changes in the printer output. The closed-loop system has the additional advantage of simple and inexpensive installation in commercial thermal ink jet printers and thermal printers since it uses the existing power supply, driver chip, interconnects, and firing resistors.

In the preferred embodiment of the closed-loop system, a firing resistor 30 receives printing pulses from a printing pulse generator 28. Temperature sensor 32 senses the temperature of printhead 26 and produces a real-time printhead temperature signal 25 that buffer-amplifier/data-converter 34 amplifies and converts into a form that the error detection amplifier 22 will accept. Error detection amplifier 22 compares this signal to a reference temperature signal 36 and generates a real-time error output signal and relays it to a closed-loop pulse generator 24 which transmits closed-loop nonprinting pulses to firing resistor 30 during the print cycle.

In the preferred embodiment, firing resistors 30 reside on the same substrate as temperature sensor 32. Temperature sensor 32 is a high resistance aluminum trace similar to aluminum traces that make up the interconnects between the firing resistors and the pulse generators with the difference being that the temperature sensor trace is a high resistance trace that experiences large changes in resistance when the temperature changes. The temperature coefficient of the aluminum converts the resistance change into a temperature change and allows one to calculate the temperature if one calibration point is known.

An alternate embodiment of the invention has one or more heating resistors located on the same substrate as the firing resistors and the temperature sensor. All pulse generators transmit their nonprinting pulses to these heating resistors instead of the firing resistors as the preferred embodiment does. This embodiment has the disadvantage of increasing the number of interconnects and increasing the amount of drive circuitry. In a software implementation of this embodiment, the software can combine the nonprinting pulses from the generators into one or more pulses and transmit them to one or more heating resistors.

Figure 1B:
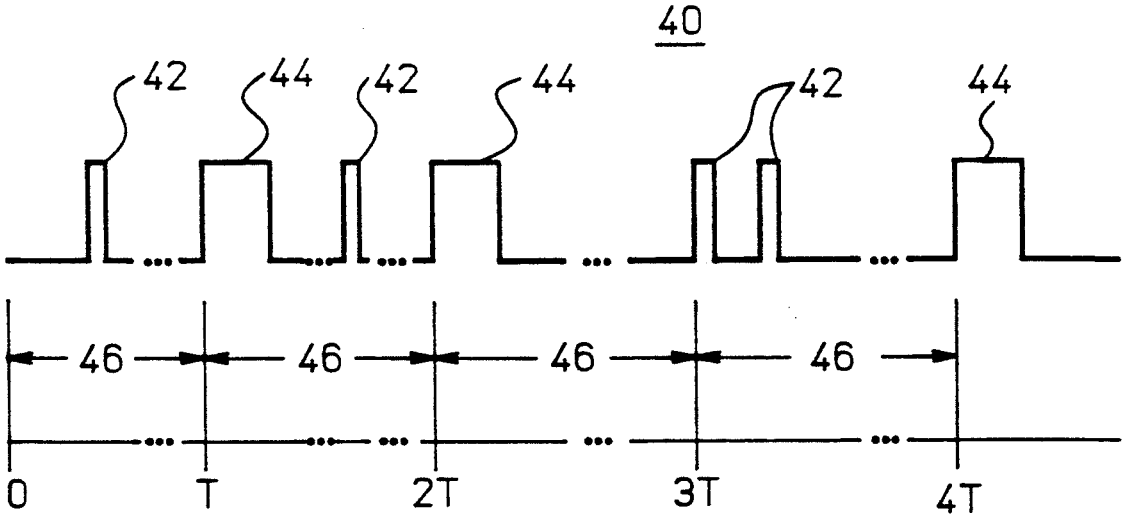
FIG. 1B shows a timing diagram of pulses the closed-loop temperature regulation system, shown in FIG. 1A, applies across the firing resistor.

FIG. 1B shows a timing diagram of the pulses transmitted to firing resistor 30. Printing pulses 44 can occur as frequently as every printing interval 46. For example, in a specific thermal ink jet printer, the printing interval has a duration of 278 μseconds and the printing pulses have a duration of approximately 3.25 μseconds.

When the temperature indicated by reference temperature signal 36 exceeds the temperature of printhead 26, error detection amplifier 22 instructs closed-loop pulse generator 24 to increase the energy of closed-loop nonprinting pulses 42, shown in FIG. 1B. These pulses travel to firing resistor 30, via a summing node 38, and heat printhead 26. Summing node 38 combines the outputs of printing pulse generator 28 and nonprinting pulse generator 24.

The present invention has the advantage of using low-energy nonprinting pulses that heat the printhead without vaporizing the ink adjacent to the firing resistor. A vaporized ink bubble acts as a heat insulator and forces the firing resistor to absorb any additional energy whether it originates with a printing pulse or a nonprinting pulse. The extra heat can cause the firing resistor to reach high temperatures and fail prematurely. Thus, the nonprinting pulses of the present invention have the advantage of heating the printhead without damaging the firing resistor.

When the printhead temperature exceeds the temperature indicated by reference temperature signal 36, closed-loop system 20 reduces the amount of energy transmitted by the closed-loop nonprinting pulses. To prevent the printhead temperature from exceeding the reference temperature after the closed-loop system 20 has reduced the energy of the closed-loop nonprinting pulses to zero, the preferred embodiment sets the reference temperature somewhere between 10° C. to 100° C. above room temperature.

The preferred embodiment of the invention employs an off-the-shelf thermal ink jet printhead and uses the aluminum trace located near the firing resistor as a temperature sensor. However, future embodiments of the invention may use a printhead specifically designed for high temperature operation. Such a printhead would have ink, adhesives, firing resistors, and an ink chamber specifically designed for high temperature operation.

Experts in the art of thermal ink jet printer design operate printheads at the lowest possible temperature because they believe it minimizes thermal stress on the printhead. These experts view the present invention with skepticism because it operates printheads at elevated temperatures. However, operating the printhead at a constant elevated temperature, per the present invention, may subject the printhead to less thermal stress than what it experiences when the temperature varies.

In the preferred embodiment, the width of closed-loop nonprinting pulses 42 varies between 0 μsecond and 1.125 μseconds according to the amount of energy they transmit. Alternate embodiments may hold the pulse width constant and vary the voltage, the number of closed-loop nonprinting pulses in one printing interval 46, or some combination of pulse width, voltage, and number of closed-loop nonprinting pulses in one interval. The important parameter is the energy carried by the pulse. The energy should be large enough to adjust the printhead temperature without causing the printer to misfire.

Closed-loop nonprinting pulses 42 can occur at any time during printing interval 46 as long as they do not interfere with the printing pulses. If a nonprinting pulse occurs before the printing pulse and interferes with it, the nonprinting pulse will alter the size of the resulting ejected drop in the manner disclosed by U.S. patent application Ser. No. 420,604, now U.S. Pat. No. 4,982,199, issued Jan. 1, 1991, invented by Dunn and assigned to the Hewlett-Packard Company. If the nonprinting pulse occurs too soon after the printing pulse when the bubble still exists, then the nonprinting pulse will raise the temperature of the firing resistor and will contribute to the premature failure of the firing resistor. Also, more than one closed-loop nonprinting pulse 42 may occur within one printing interval as shown in FIG. 1B.

Figure 3B:
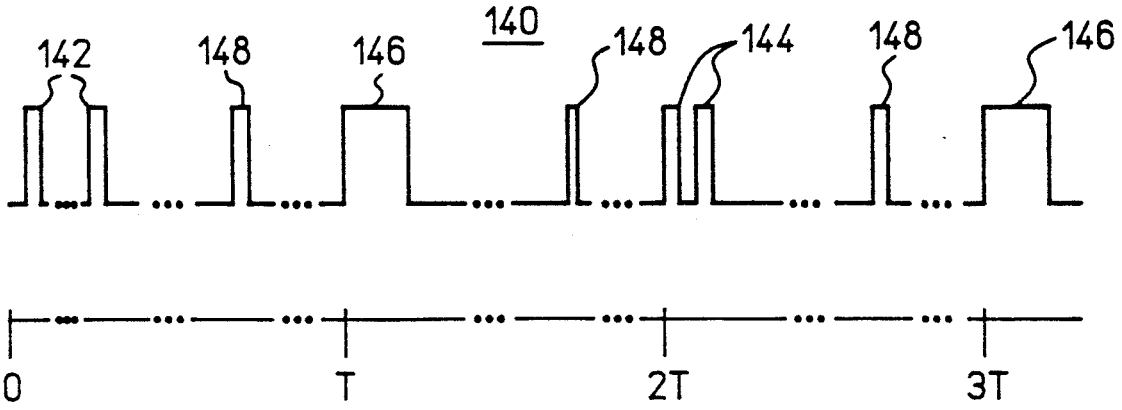
FIG. 3B shows a timing diagram of pulses the hybrid system, shown in FIG. 3A, applies across the firing resistor.
Figure 3A:
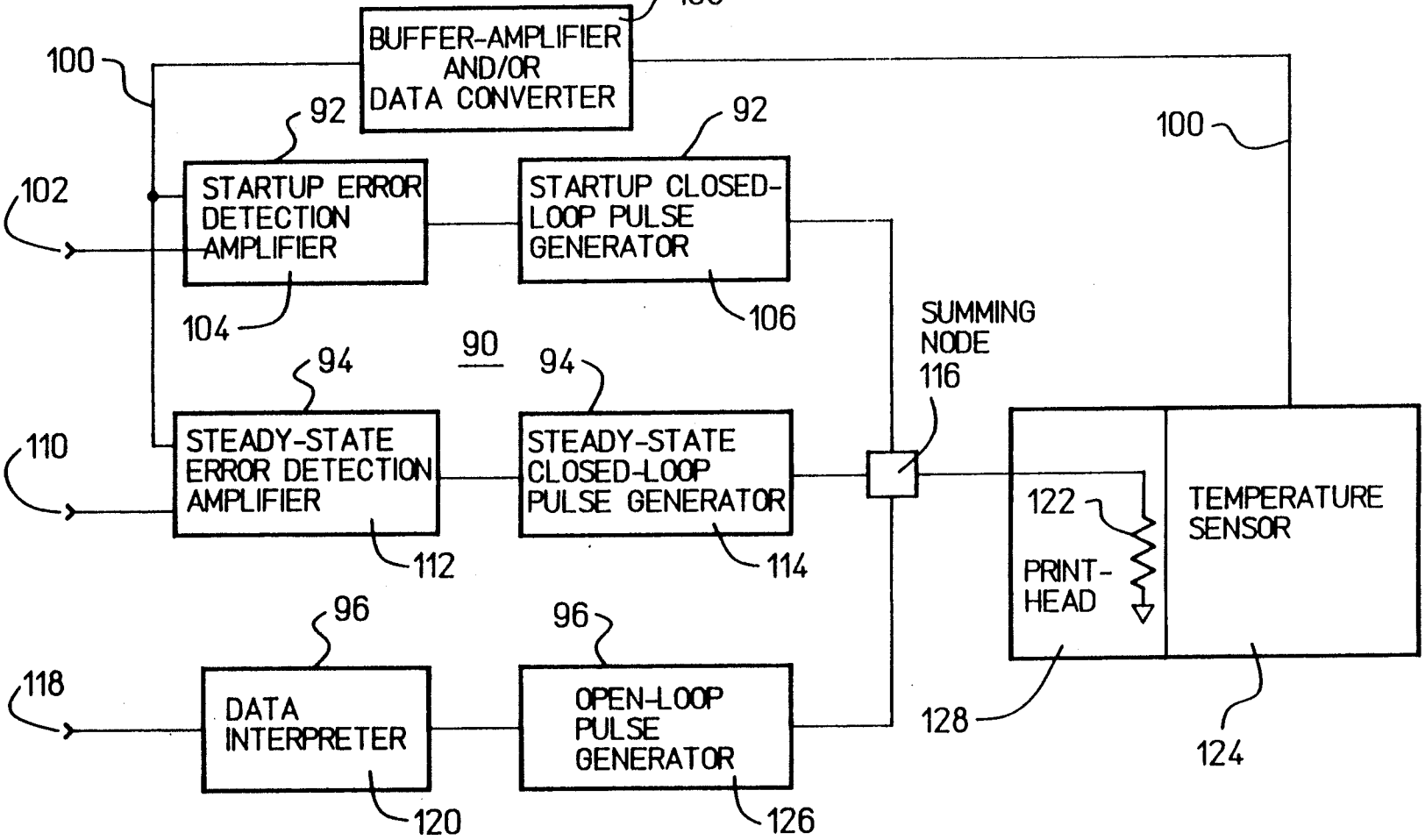
FIG. 3A shows a block diagram of a hybrid system that combines the closed-loop temperature regulation system of FIG. 1A and the open-loop energy compensation system of FIG. 2A.

Alternate embodiments of closed-loop system 20 may have multiple feedback loops having different response times. FIG. 3A shows a hybrid system 90 that has multiple closed loops. One loop 94 has a slow response time, such as 1 to 10 seconds, and adjusts the energy carried by closed-loop nonprinting pulses 148 to compensate for drifts in ambient temperature. Another loop 92 has a fast response time, in the millisecond range, and adjusts the energy carried by closed-loop nonprinting pulses 142 to drive the printhead temperature to the reference temperature as quickly as possible. Alternate embodiments may have a third closed loop that replaces open-loop system 96. This loop compensates for changes in the power dissipation of a printhead caused by changes in the printer output by adjusting the energy carried by the closed-loop nonprinting pulses.

When the ambient temperature has stabilized and the thermal transients that occur during startup have passed, the temperature of prior-art printheads varies with the number of printing pulses because the ejected drops absorb only a portion of the printing pulse energy and leave the printhead to absorb the remainder. Thus, the printhead temperature rises with increases in printer output and falls with decreases in printer output.

Figure 2A:
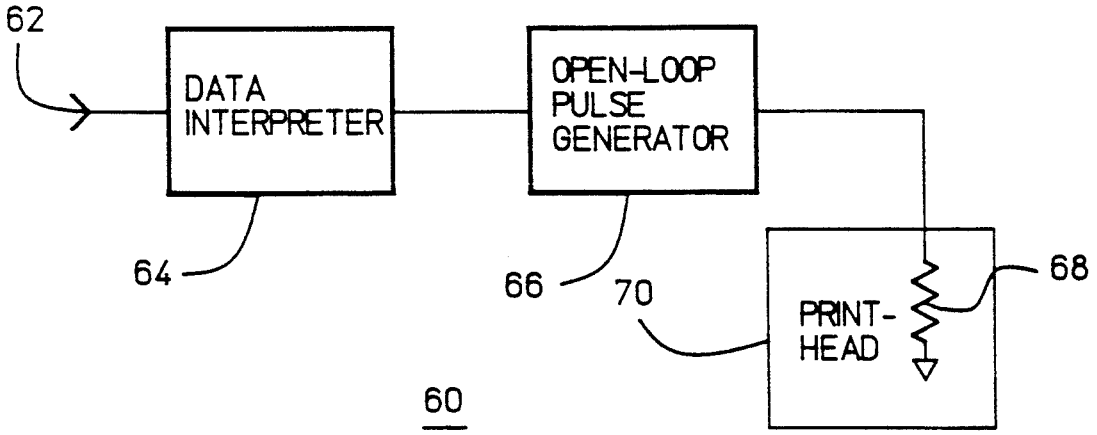
FIG. 2A shows a block diagram of the open-loop energy compensation system for maintaining constant printhead temperature.
Figure 2B:
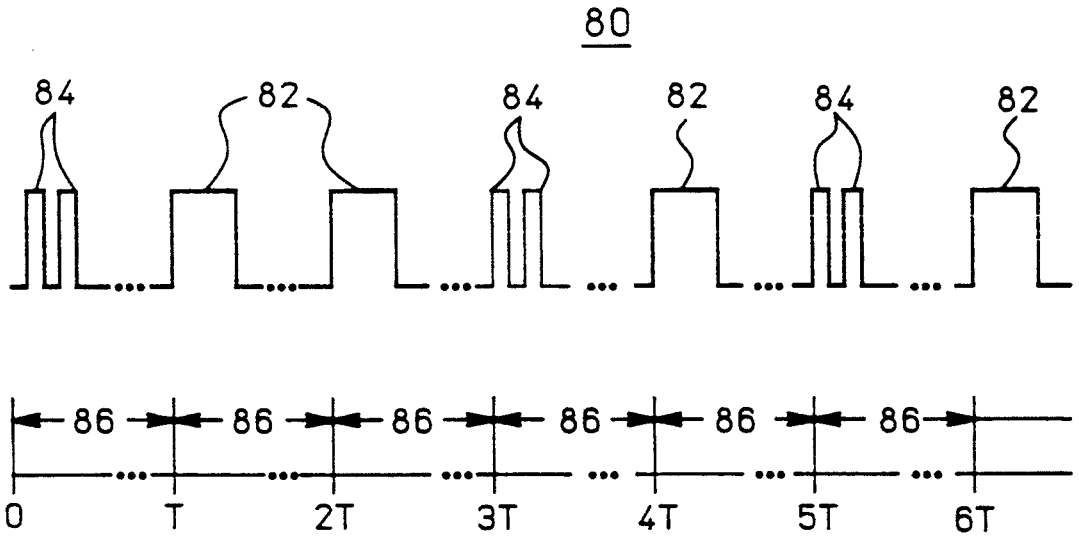
FIG. 2B shows a timing diagram of pulses the open-loop energy compensation system, shown in FIG. 2A, applies across the firing resistor.

When one knows the energy transfer characteristics of a printhead such as the percentage of the printing pulse energy transferred to an ejected drop (X) and the percentage of the printing pulse energy absorbed by the printhead (100−X), then one can use open-loop system 60 shown in FIG. 2A to maintain a constant heat flow to the printhead regardless of the content of print data 62. FIG. 2B shows a timing diagram 80 of the pulses that open-loop system 60 applies across firing resistor 68. During each interval, open-loop pulse generator 66 applies either a printing pulse 82 or one or more open-loop nonprinting pulses 84 across firing resistor 68. Data interpreter 64 reads print data 62. If it contains a print command in a printing interval 86, then data interpreter 64 instructs open-loop pulse generator 66 to generate printing pulse 82. Otherwise, data interpreter 64 instructs open-loop pulse generator 66 to generate one or more open-loop nonprinting pulses 84.

This open-loop system 60 compensates for changes in the energy flow to the printhead caused by variations in the printer output. It can not compensate for fluctuations in the printhead temperature caused by other factors such as changes in the ambient temperature and thermal transients that occur during startup. The closed-loop system compensates for these fluctuations.

An apparatus similar to that shown in FIG. 2A can measure the energy transfer characteristics of a printhead, such as the amount of energy transferred to an ejected drop and the amount of energy absorbed by the printhead when ejecting a drop. This measurement has the following steps. First, for each firing resistor participating in this measurement (any number of firing resistors greater than one may be used), a printer controller sends print data 62 containing one print command per printing interval 86 to data interpreter 64. Data interpreter 64 responds by signaling open-loop pulse generator 66 to send one printing pulse having an energy $E_p$ to the firing resistor each printing interval. When the printhead reaches "thermal equilibrium" (i.e., the printhead temperature stabilizes), a temperature sensor, located on the same substrate as the firing resistor, measures the printhead's thermal equilibrium temperature. Second, the printer controller sends print data 62 that does not have a print command in any printing interval to data interpreter 64. The data interpreter 64 instructs open-loop pulse generator 66 to transmit nonprinting pulses to the firing resistor. The energy carried by the nonprinting pulses in one printing interval is adjusted until the printhead temperature stabilizes at the same thermal equilibrium temperature measured in the first step. Third, the amount of energy transmitted in one printing interval by the nonprinting pulses that caused the printhead to stabilize at the thermal equilibrium temperature is measured. Fourth, this energy is subtracted from the energy of one printing pulse to obtain the amount of energy carried by one ejected drop. The energy transmitted by the nonprinting pulses equals the energy absorbed by the printhead when ejecting a drop.

The preferred embodiment of the invention is a hybrid system 90, shown in FIG. 3A, that has a startup closed loop 92, a steady-state closed loop 94, and an open-loop system 96. This system compensates for all fluctuations in the printhead temperature: those caused by variations in the printer output as well as fluctuations caused by the startup condition and changes in the ambient temperature. Open-loop system 96 is the same open-loop system shown in FIG. 2A and closed-loop systems 92, 94 are similar to those shown in FIG. 1A. Alternate embodiments of the invention may require more closed-loop systems.

Multiple closed loops have the advantage of achieving complex nonlinear responses to temperature fluctuations. Startup closed loop 92 has a fast response time for heating the printhead during its startup phase, it responds quickly to a difference between the printhead temperature signal 100 and the startup reference temperature signal 102. Steady-state closed loop 94 has a slow response time for tracking changes of the printhead temperature due to changes in the ambient temperature and other slowly changing factors. Since this loop responds slowly to changes, steady-state closed loop 94 will tend to produce steady-state closed-loop pulses 148 on a regular basis as shown in FIG. 3B.

This hybrid system has the advantage of easy implementation because it can use the spare time of the processor in the printer controller. The startup closed loop functions when the processor does not have much to do so the loop can use a large percentage of the processor's time and thereby achieve a fast response time. The steady-state closed loop does not require much processor time and can function using the spare time of the processor while it controls printing operations.

To prevent the nonprinting pulses from overheating the printhead with too much energy too soon and causing the printhead to misfire, the closed-loop and open-loop systems can generate several nonprinting pulses in one printing interval which divide up the energy that would otherwise be carried by one nonprinting pulse. FIG. 3B shows two of the startup closed-loop nonprinting pulses 142 generated by startup closed loop 92 of FIG. 3A and shows that open-loop system 96 generates two open-loop nonprinting pulses 144 in one printing interval. The startup closed loop system can further protect against misfiring by moving the printhead out of range of the print medium when issuing the nonprinting pulses.

The startup closed loop 92 and steady-state closed loop 94 operate like closed-loop system 20 shown in FIG. 1A. Temperature sensor 124 produces a printhead temperature signal 100 which travels to a buffer-amplifier/data-converter 108 that amplifies this signal and converts into a form acceptable to error detection amplifiers 104, 112. Error detection amplifiers 104, 112 compare this signal to startup reference temperature signal 102 and steady-state reference temperature signal 110, respectively. The output of these error detection amplifiers travels to startup closed-loop pulse generator 106 to generate start-up closed-loop nonprinting pulses 142 and to steady-state closed-loop pulse generator 114 to generate steady-state closed-loop nonprinting pulses 148, respectively. In the preferred embodiment, the closed-loop systems control the energy of closed-loop nonprinting pulses 142, 148 by controlling their widths.

In alternate embodiments of the invention, startup reference temperature signal 102 may be less than the steady-state reference temperature signal 110. When the printhead temperature exceeds the temperature indicated by startup reference temperature signal 102, startup closed loop 92 shuts down and steady-state closed loop 94 carries out all temperature regulation. In alternate embodiments of the invention, startup reference temperature signal 102 may be a little more or a lot more than the steady-state reference temperature signal 110 so that startup closed loop 92 will heat the printhead faster. When the printhead reaches a pre-set temperature, the software or electronics will shut-down startup closed loop 92 and steady-state closed loop 94 will take over temperature regulation.

FIG. 3A shows the preferred embodiment of the invention as having two physically separate closed loops. A software implementation of this invention could merge the two loops into one loop with two different response times. If a more complex nonlinear response is required, additional loops may be added, perhaps some with a variable response time. A software implementation could also merge the output of the closed-loop systems to the open-loop system as long as it does not merge a printing pulse with a nonprinting pulse and as long as the energy of the resulting nonprinting pulse can not cause the printhead to misfire.

The energy compensation section 96 of hybrid system 90 consists of print data 118, a data interpreter 120, and an open-loop pulse generator 126. Data interpreter 120 decides whether open-loop pulse generator 126 should generate a printing pulse or one or more open-loop nonprinting pulses and open-loop pulse generator 126 applies these pulses across firing resistor 122. Summing node 116 merges the output of the various pulse generators onto a single trace bound for firing resistor 122.

The claims define the invention. Therefore, the foregoing Figures and Detailed Description show a few example systems possible according to the claimed invention. However, it is the following claims that both (a) define the invention and (b) determine the invention's scope.

What is claimed is:

1. An apparatus for real-time, closed-loop control of a printhead temperature, comprising:

a. a temperature sensor that:
   i. senses the printhead temperature; and
   ii. produces a real-time printhead temperature signal;

b. an error detection amplifier, that:
   i. has an input connected to a reference temperature signal;
   ii. has an input connected to the printhead temperature signal; and
   iii. generates a real-time error output signal that is a function of a difference between the reference temperature signal and the printhead temperature signal;

c. a means for generating a number of closed-loop nonprinting pulses having a width, a voltage, an energy, and a timing; and d. a means for using the error output signal to control the timing of the number of closed-loop nonprinting pulses and the energy delivered by the number of closed-loop nonprinting pulses to the printhead to achieve real-time, closed-loop control of the printhead temperature.

2. An apparatus as in claim 1, further comprising:

a. a second error detection amplifier, that:
   i. has an input connected to a second reference temperature signal;
   ii. has an input connected to the printhead temperature signal; and
   iii. generates a real-time error output signal that is a function of a difference between the second reference temperatures signal and the printhead temperature signal;

b. a second means for generating a number of closed-loop nonprinting pulses in real time having a width, a voltage, an energy, and a timing; and c. a means for using the error output signal to control the timing of the number of closed-loop nonprinting pulses and the energy delivered by the number of closed-loop nonprinting pulses to the printhead to achieve real-time closed-loop control of the printhead temperature.

3. An apparatus as in claim 1 wherein the means for generating a number of closed-loop nonprinting pulses further comprises a means for varying the energy transmitted by the number of closed-loop nonprinting pulses by varying the width of the closed-loop nonprinting pulses.

4. An apparatus as in claim 1 wherein the means for generating a number of closed-loop nonprinting pulses further comprises a means for varying the energy transmitted by the number of closed-loop nonprinting pulses by varying the voltage of the closed-loop nonprinting pulses.

5. An apparatus as in claim 1 wherein the means for generating a number of closed-loop nonprinting pulses further comprises a means for varying the energy transmitted by the number of closed-loop nonprinting pulses by varying the number of closed-loop nonprinting pulses in one printing interval.

6. An apparatus as in claim 1 wherein the number of closed-loop nonprinting pulses drive a firing resistor.

7. A method for real-time, closed-loop control of a printhead temperature, comprising the steps of:

a. sensing the printhead temperature;
b. producing a real-time printhead temperature signal;
c. comparing the printhead temperature signal to a reference temperature signal;
d. generating a real-time error output signal that is a function of a difference between the reference temperature signal and the printhead temperature signal;
e. generating a real-time, closed-loop nonprinting pulse having a timing and having an energy; and
f. using the error output signal to control the timing of the closed-loop nonprinted pulse and the energy transferred by the closed-loop nonprinting pulse to the printhead to achieve real-time, closed-loop control of the printhead temperature.

8. A method for calculating energy carried by a drop ejected from a thermal ink jet printhead, comprising the steps of:

a. driving the printhead to thermal equilibrium by driving a firing resistor each printing interval with one printing pulse that has a printing pulse amount of energy;
b. measuring the printing pulse amount of energy;
c. measuring a printhead thermal equilibrium temperature after the printhead has reached thermal equilibrium;
d. driving the firing resistor with one or more nonprinting pulses each printing interval that have a nonprinting pulse amount of energy each printing interval, instead of driving the firing resistor with one printing pulse;
e. adjusting the nonprinting pulse amount of energy until the printhead temperature equals the printhead thermal equilibrium temperature;
f. measuring the nonprinting pulse amount of energy; and
g. calculating the energy carried by the drop by subtracting the nonprinting pulse amount of energy from the printing pulse amount of energy.

9. An apparatus for real-time, open-loop control of a temperature of a thermal ink jet printhead, comprising:

a. a data interpreter that interprets a plurality of print data to determine whether a print command exists;
b. a means for generating, in response to a print command, a printing pulse that drives a firing resistor with a firing engine, having an ejecting component and a heating component;
c. a means for ejecting a drop having the ejecting component of said firing engine and for heating the printhead with the heating component of said firing energy when the firing resistor is driven with the printing pulse; and
d. a means for generating, in response to an absence of the print command, one or more open-loop nonprinting pulses that heat the printhead with the heating component of said firing energy.

10. An apparatus, as in claim 9, wherein the open-loop nonprinting pulses drive the firing resistor.

11. A method for real-time open-loop control of a temperature of a thermal ink jet printhead, comprising the steps of:

a. interpreting a plurality of print data to determine whether a print command exists;
b. generating, in response to the print command, a printing pulse that drives a firing resistor with a firing energy having an ejecting component and a heating component;
c. ejecting a drop having the ejecting component of said firing energy when the firing resistor is driven with a printing pulse;
d. heating the printhead with the heating component of said firing energy when the firing resistor is driven with the printing pulse;
e. generating, in response to an absence of the print command, one or more nonprinting pulses that have a total energy of the heating component of said firing energy for heating the printhead.

12. An apparatus for real-time control of a temperature of a thermal ink jet printhead, comprising: an open-loop system having:

a. a data interpreter that interprets a plurality of print data to determine whether a print command exists;
b. a means for generating, in response to a print command, a printing pulse that drives a firing resistor with a firing energy having an ejecting component and a heating component;
c. a means for ejecting a drop having the ejecting component of said firing energy and for heating the printhead with the heating component of said firing energy when the firing resistor is driven with the printing pulse;
d. a means for generating, in response to an absence of the print command, one or more open-loop nonprinting pulses that heat the printhead with the heating component of said firing energy; and a closed-loop system, having:
e. a temperature sensor that:
   i. sense the printhead temperature; and
   ii. produces a real-time printhead temperature signal;
f. an error detection amplifier, that:
   i. has an input connected to a reference temperature signal;
   ii. has an input connected to the printhead temperature signal; and
   iii. generates a real-time error output signal that is a function of a difference between the reference temperature signal and the printhead temperature signal;
g. a means for generating a number of closed-loop nonprinting pulses having a width, a voltage, an energy, and a timing; and
h. a means for using the error output signal to control the timing of the number of closed-loop nonprinting pulses and the energy delivered by the number of closed-loop nonprinting pulses to the printhead to achieve real-time, closed-loop control of the printhead temperature.

13. An apparatus, as in claim 12, wherein the open-loop nonprinting pulses and the closed-loop nonprinting pulses drive the firing resistor.

14. An apparatus, as in claim 12, further comprising:

i. a means for summing the closed-loop nonprinting pulses and the open-loop nonprinting pulses and transmitting them to the firing resistor.

15. An apparatus, as in claim 12, further comprising: a second closed loop system, having:

a. a second error detection amplifier, that:
   i. has an input connected to a second reference temperature signal;

ii. has an input connected to the printhead temperature signal; and iii. generates a real-time error output signal that is a function of a difference between the second reference temperature signal and the printhead temperature signal; and b. a second means for generating a number of closed-loop nonprinting pulses having an energy and having a timing; and c. a second means for using the error output signal to control the timing of the number of closed-loop nonprinting pulses and the energy delivered to the printhead by the number of closed-loop nonprinting pulses to achieve real-time, closed-loop control of the printhead temperature.

* * * * *